US007667409B2

(12) United States Patent
Geerts et al.

(10) Patent No.: US 7,667,409 B2
(45) Date of Patent: Feb. 23, 2010

(54) METHOD FOR DRIVING A LAMP IN A LIGHTING SYSTEM BASED ON A GOAL ENERGIZING LEVEL OF THE LAMP AND A CONTROL APPARATUS THEREFOR

(75) Inventors: Renatus Bernardinus Maria Geerts, Achtmaal (NL); Jacobu Stegeman, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 479 days.

(21) Appl. No.: 11/570,944

(22) PCT Filed: Jun. 28, 2005

(86) PCT No.: PCT/IB2005/052137

§ 371 (c)(1),
(2), (4) Date: Dec. 19, 2006

(87) PCT Pub. No.: WO2006/003613

PCT Pub. Date: Jan. 12, 2006

(65) Prior Publication Data

US 2008/0278094 A1 Nov. 13, 2008

(30) Foreign Application Priority Data

Jul. 2, 2004 (EP) ..... 04103139

(51) Int. Cl.
*H05B 37/00* (2006.01)

(52) U.S. Cl. ..... 315/224; 315/291; 315/307; 315/209 R; 315/DIG. 4

(58) Field of Classification Search ..... 315/224, 315/225, 291, 307–311, DIG. 4
See application file for complete search history.

(56) References Cited

U.S. PATENT DOCUMENTS

| | | | |
|---|---|---|---|
| 4,475,061 | A | 10/1984 | Van De Weijer et al. |
| 5,668,446 | A | 9/1997 | Baker |
| 6,151,234 | A | 11/2000 | Olenkamp |
| 6,181,065 | B1 | 1/2001 | Huettinger et al. |
| 6,337,804 | B1 | 1/2002 | Kea et al. |
| 2002/0005861 | A1 | 1/2002 | Lewis |
| 2003/0234621 | A1 | 12/2003 | Kriparos |

FOREIGN PATENT DOCUMENTS

| | | | |
|---|---|---|---|
| CA | 2276453 | A1 | 12/1999 |
| JP | 11298416 | A | 10/1999 |
| WO | 8704890 | A1 | 8/1987 |
| WO | 9320671 | A1 | 10/1993 |
| WO | 9914988 | A1 | 3/1999 |

OTHER PUBLICATIONS

Siegfried Luger, et al: Beleuchtung Wird Busfahig, No. 26, Dec. 1992, pp. 26-30, XP000327405.

*Primary Examiner*—Tuyet Vo

(57) ABSTRACT

A method and a control apparatus for driving a lamp (14) in a lighting system, in particular a lamp laving a fast response to a change of an amount of energy supplied through the lamp, in which a device controller 8 is connected with the lamp (14) The device controller (8) receives data values from a system controller (2) to change a light output level of the lamp (14). Upon receiving a data value which is different from a previously received data value the device controller calculates additional data values and distribute the additional data values in a following, time interval to smoothen a transition between different light output levels of the lamp (14).

7 Claims, 2 Drawing Sheets

METHOD FOR DRIVING A LAMP IN A LIGHTING SYSTEM BASED ON A GOAL ENERGIZING LEVEL OF THE LAMP AND A CONTROL APPARATUS THEREFOR

FIELD OF THE INVENTION

The invention relates to a method for driving a lamp in a lighting system as described in the preamble of claim 1 and a control apparatus for driving such lamp as described in the preamble of claim 6. More in particular, the lamp is of a type having a fast response to a change of an amount of energy supplied thereto, such as a lamp comprising light emitting diodes (LEDs).

BACKGROUND OF THE INVENTION

A method of said type is known from practice. In particular such a method is known for driving an incandescent lamp, in which the driver comprises a triac, which is connected in series with the lamp and an alternating voltage source. The triac is controlled by a control signal which determines a phase of each period of the alternating voltage at which the triac is made conductive. If a current through the triac decreases below some threshold the triac will stop conducting. This type of driver is well known from its use in homes.

For some years now it is a trend to control its state, that is the amount of energy supplied to it, from a remote controller. Several lamp devices can be connected to such remote controller by a data communication line and to a mains supply source by mains lines. The remote controller can control the state of the lamps contained in on or more lamp devices. In this way one can build a large lighting system with remote control of lamps of different lamp devices with few wiring for control and mains supply.

Light systems of the above type are known from practice. Several protocols, such as DMX and DALI, are known to transfer data from the remote controller to a device controller of each lamp device. In particular, data to control the energy state of a lamp comprises 8 bits. Therefore a light output of a lamp can be controlled in 255 steps to 256 different light output levels of the lamp. Such data can be determined by a lighting scheme which is programmed in the remote controller, or it can be instructed from a manually controllable control device at a distant from the remote controller mentioned above.

When the amount of energy supplied to an incandescent lamp is changed it will take some time to attain a new steady temperature which is associated with the changed amount of energy supplied to the lamp. Therefore, when changing said amount of energy a person will not notice a step like change in the light output of the lamp.

When using a lamp with a faster response to a change of the amount of energy supplied to the lamp a person may notice a step like change in the light output of the lamp, in particular if said change of the amount of energy supplied to the lamp spans several of said 255 steps at a time. This can be annoying for the person.

OBJECT OF THE INVENTION

It is an object of the invention to solve the drawbacks of the prior art as described above.

SUMMARY OF THE INVENTION

The above object of the invention is achieved by providing a method as described in claim 1.

With said method a transition between different steady light output levels of the lamp, which are in accordance with the data supplied to a controller connected to the lamp, can be made gradual, such that a person will not notice a step like change of the light output.

The above object of the invention is achieved also by providing a control apparatus as described in claim 6.

BRIEF DESCRIPTION OF THE DRAWINGS

The invention will become more gradually apparent from the following exemplary description in connection with the accompanying drawing. In the drawing.

DETAILED DESCRIPTION OF EXAMPLES

Figure 1:
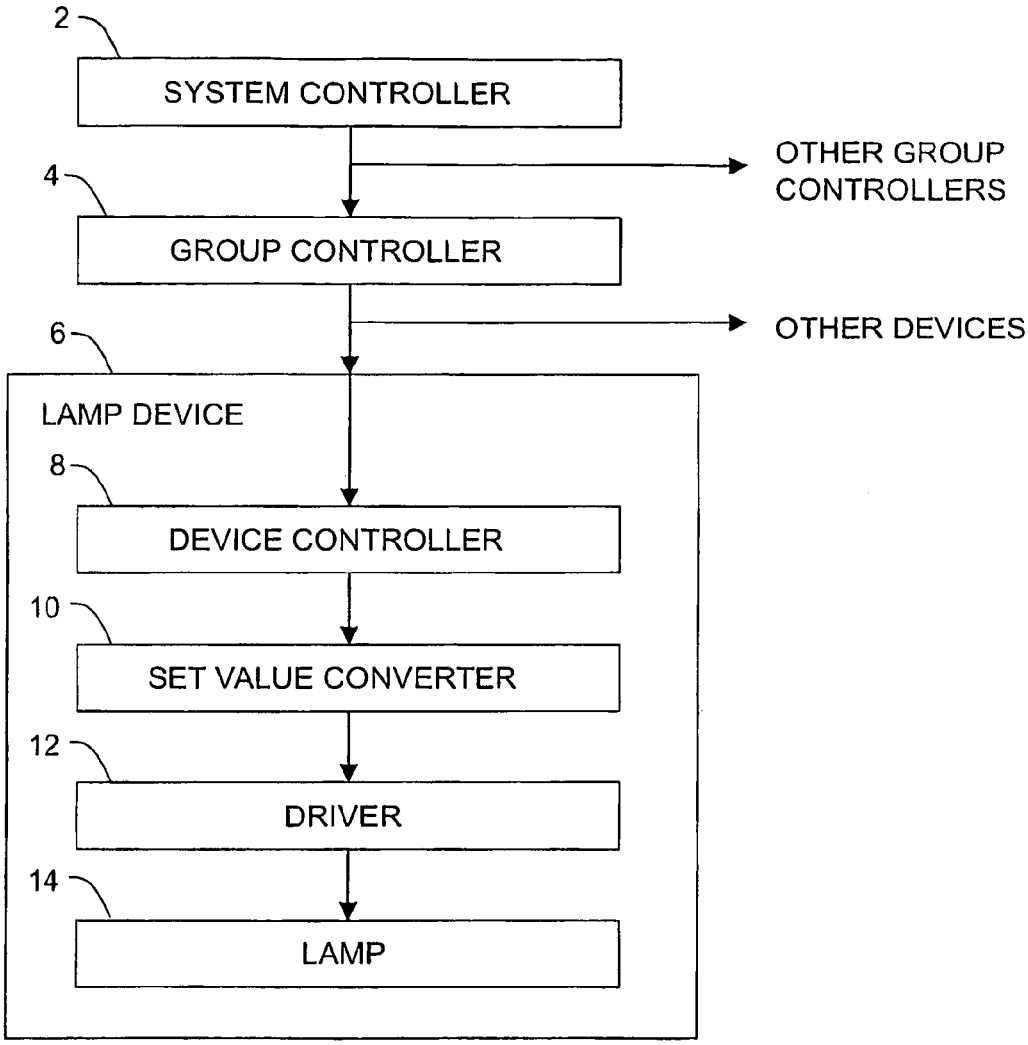
FIG. 1 shows a diagram of an embodiment of a lighting system which is suitable for applying the method according to the invention and for illustrating a lighting system according to the invention.

The diagram shown in FIG. 1 is applicable for illustrating both a prior art lighting system and a lighting system in which the invention has been incorporated.

The illustrative lighting system of FIG. 1 comprises a system controller 2, which is connected to one or several group controllers 4 which can be remote from the system controller. Any group controller 4 can be connected to one or several devices, such as a lamp device 6 or a manually controllable control device (not shown), and which can be remote from the group controller 4 connected to it.

A lamp device 6 may comprise a device controller 8, which is connected to a set or goal value converter 10, which is connected to a driver 12, which is connected to a lamp 14. The device controller 8 is connected to a group controller 4.

In case of the lighting system of FIG. 1 being a prior art system, the lamp can be an incandescent lamp, the driver can be a semiconductor switch, in particular a triac, and the set value converter can be a combination of a digital-to-analogue converter and a triac ignition pulse generator.

The device controller 8 of a lamp device will receive data at one or more instants. Such instants may succeed each other periodically or not. For example, the system controller 2 may periodically scan any remote control device and may, upon determining a change of a state of the control device, determine new data to be sent to, for example, a lamp device 6 for changing a light output of a lamp 14 of the lamp device 6.

In case a lamp 14 is of a type having a fast response to a change of an amount of energy supplied thereto from the driver 12, a person may notice a step like change in the light output of the lamp 14, which can be annoying to the person. An example of a lamp having such fast response is a lamp comprising light emitting diodes (LEDs). In that case the driver 12 will supply a direct current with direct voltage to the lamp 14.

To limit a band width for communication between controllers of the lighting system and to be able to use well known techniques and data processors, the data sent by the system controller 2 to a device controller 8 comprises 8 bits. To decrease a step like change of the light output of the lamp output of the lamp 14 one could consider to increase the number of bits of said data. However, each additional bit requires twice the transmission rate to establish a certain change in light output of the lamp 14. Therefore increasing said amount of bits is not practical and not economical.

As explained below, according to the invention a higher resolution of light output levels of the lamp 14 is established between successive instants at which it receives different data. The higher resolution provides a gradual change or gradual transition between light output levels associated with the data received at different instants, respectively.

Figure 2:
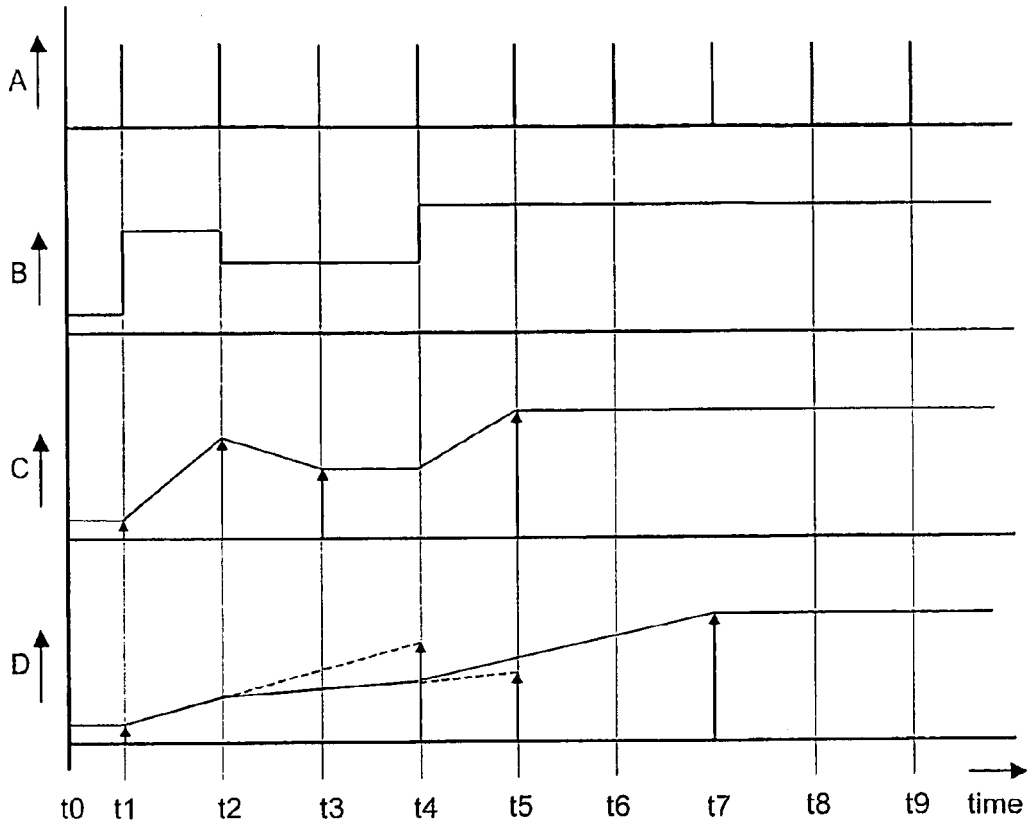
FIG. 2 shows a time diagram of example events and signals which may occur in the embodiment of the lighting system shown in FIG. 1.

FIG. 2 shows a time diagram of events and signals which may occur in the lighting system shown in FIG. 1 in which the invention has been incorporated.

The top line A of FIG. 2 shows events occurring on instants t1 to t9 on which the device controller 8 receives, or may receive, data from the system controller 2.

At the second line B of FIG. 2 a value of received data is shown. The received data can be stored in device controller 8.

The third line C of FIG. 2 shows a control signal which is generated by the set value converter 10 and which is supplied to driver 12.

The bottom line D of FIG. 2 shows an alternative for the control signal illustrated by line C.

For illustration purposes it is supposed that at a time t0 the lamp device 6 stored data which represents a relatively small value, as indicated by line B, which value is converted by the set value converter 10 to a small value of the control signal indicated by line C, which results in a light output of the lamp 14 having a relatively low level.

As indicated by line B, at the time t9 a larger data value has been stored, which results in a high amplitude of the control signal, as indicated by line C, which in turn results in a high light output level of the lamp 14.

According to the invention, when receiving a new data value which is different from a previously received data value, the device controller 8 is programmed to calculate a plurality of additional data values by interpolating between the currently received data value and the previously received data value, and to distribute the additional data values over a time interval of specific duration which follows the receiving of the currently received data value.

As indicated by line B, at time t1 a data value is received which is larger than a previously received data value. Then, the device controller 8 will calculate and distribute additional data values such, that the control signal, shown by line C, will have a raising ramp between the times t1 and t2.

At time t2 a data value is received which is smaller than the data value received at time t1. Therefore the control signal will have a descending ramp between times t2 and t3.

At time t3 a data value is received which is identical to the data value received at time t2. Therefore the control signal will not change between times t3 and t4.

At time t4 a data value is received which is larger than the data value received at time t3. Therefore the control signal will have a raising ramp between times t3 and t4.

At time t5 a data value is received which is identical to the data value received at time t4. Therefore the control signal will not change between times t4 and t5.

Applying such ramps in the control signal, as shown by line C, will reduce the perceptibility of step like changes in light output level of the lamp 14 by a person.

Although line C shows straight ramps they may consist of a large number of small steps. In addition, the device controller 8 can be programmed to calculate the additional data values to apply any smooth curve at places were line C of FIG. 2 shows a straight ramp.

The perceptibility of changes of light output level of the lamp 14 can further be decreased by distributing said calculated additional data values over a period of a time which is longer than a time interval at which data can be received by the device controller 8 from the system controller 2. Line D shows an example of a control signal in which the calculated additional data values are distributed over three time intervals at which data can be received by the device controller 8. Therefore the ramps shown in line D will be less steep than in line D. Still in addition, upon receiving a data value which is different from a previously received data value the additional data values are calculated as to be in a range between a value currently reached by the control signal and the currently received data value. In that case, as can be clear from line D of FIG. 2, transitions of the light output level of lamp 14 can be made even smoother.

It is possible that a system controller 2 will not transmit data values to a lamp device 6 under all circumstances with fixed intervals. The system controller 2 can be programmed to transmit only changed data values, possibly with some repetitions in-between. In such case a time interval over which calculated additional data values are distributed can be changed dependent on a rate at which altered data values are received by the device controller 8.

The device controller 8 may measure a duration of a time interval between the receiving of two successive data values and to distribute the additional calculated data values dependent on a such measured duration.

It is observed that the lamp 14 can be driven by pulses of which the width has been modulated by a control signal such as indicated by line C or D of FIG. 2. In that case such pulses have a period which is much smaller than a data receipt time interval, such as a time interval between t1 and t2.

The invention claimed is:

1. Method for driving a lamp in a lighting system, the lamp comprising a device controller (8) and a driver (12), wherein the device controller is periodically supplied with data of a set value representing a goal energizing level for the lamp, the set value is converted to a driver control signal, and the driver is supplied with the driver control signal for driving the lamp, wherein interpolated values are generated between a last value used for generating the driver control signal and a last supplied set value, and then the interpolated values are distributed over a succeeding distribution period, and the interpolated values are used to generate the driver control signal during the distribution period, and wherein the driver control signal is a pulse width modulated signal which is modulated by a current value for generating the driver control signal, and a period of pulses of the driver control signal is identical to a period of succeeding distributed interpolated values of the interpolation period.

2. Method according to claim 1, wherein the distribution period has a duration which is longer than a previous data supply interval.

3. Method according to claim 1, wherein the distribution period has a duration which is identical to a duration of a previous data supply interval.

4. Method according to claim 3, wherein the duration of the previous data supply interval is measured.

5. Control apparatus for driving a lamp in a lighting system, the lamp comprising a device controller, a converter and a driver, wherein the device controller is periodically supplied with data of a set value representing a goal energizing level for the lamp, the converter (10) converts the set value to a driver control signal, and the driver is supplied with the driver control signal for driving the lamp, wherein the device controller generates interpolated values between a last value used for generating the driver control signal and a last supplied set value, the device controller then distributes the interpolated values over a succeeding distribution period, and the converter converts the interpolated values to generate the driver control signal during the distribution, and wherein the converter generates the driver control signal as a pulse width modulated signal which is modulated by a current value for generating the driver control signal, and a period of pulses of the driver control signal is identical to a period of succeeding distributed interpolated values of the interpolation period.

6. Control apparatus according to claim 5, wherein the distribution period has a duration which is identical to a duration of a previous data supply interval.

7. Control apparatus according to claim 5, wherein the distribution period has a duration which is longer than a previous data supply interval.

* * * * *